US007823531B2

(12) United States Patent
Smith

(10) Patent No.: US 7,823,531 B2
(45) Date of Patent: Nov. 2, 2010

(54) CONTROL APPARATUS

(75) Inventor: Philip W Smith, Beloit, WI (US)

(73) Assignee: Paperchine Inc., Rockton, IL (US)

( * ) Notice: Subject to any disclaimer, the term of this patent is extended or adjusted under 35 U.S.C. 154(b) by 0 days.

(21) Appl. No.: 11/402,280

(22) Filed: Apr. 11, 2006

(65) Prior Publication Data

US 2007/0062924 A1 Mar. 22, 2007

Related U.S. Application Data

(60) Provisional application No. 60/670,206, filed on Apr. 11, 2005.

(51) Int. Cl.
*B05C 1/08* (2006.01)

(52) U.S. Cl. ..... 118/249; 118/227; 118/255; 118/261; 100/158 R; 100/168

(58) Field of Classification Search ..... 118/227, 118/249, 255, 261, 262; 427/428.11, 428.12, 427/428.15, 428.17, 428.21; 100/50, 168, 100/169, 170, 158 R; 101/247, 216, 218, 101/480; 162/358.1, 361

See application file for complete search history.

(56) References Cited

U.S. PATENT DOCUMENTS

| | | | | |
|---|---|---|---|---|
| 5,413,806 | A * | 5/1995 | Braun | 427/9 |
| 5,431,731 | A * | 7/1995 | Salo et al. | 118/225 |
| 5,743,964 | A * | 4/1998 | Pankake | 118/712 |
| 6,409,857 | B2 * | 6/2002 | Pallas et al. | 156/64 |
| 2003/0164229 | A1 * | 9/2003 | Nikolovski | 165/428 |

* cited by examiner

*Primary Examiner*—Laura Edwards
(74) *Attorney, Agent, or Firm*—David J. Archer

(57) ABSTRACT

A control apparatus is disclosed for controlling nip pressure in a nip of a metering size press. The apparatus includes a metering size press roll and a backing roll which cooperates with the size press roll for defining therebetween the nip. A support post is provided for rotatably supporting the backing roll. A linear bearing is disposed beneath the support post for mounting the support post. Also, a moving device is connected to the support post for moving the support post and the backing roll supported by the support post such that the supported backing roll and the support post mounted on the linear bearing is moved for controlling the nip pressure in the nip between the rolls.

14 Claims, 3 Drawing Sheets

CONTROL APPARATUS

CROSS REFERENCE TO RELATED APPLICATION

The present disclosure is a Complete application pursuant to a Provisional Patent application U.S. Ser. No. 60/670,206 filed Apr. 11, 2005. All of the disclosure of the aforementioned provisional application is incorporated herein by reference.

BACKGROUND OF THE INVENTION

1. Field of the Invention

The present invention relates to a control apparatus.

More particularly, the present invention relates to a control apparatus for controlling nip pressure in a nip of a metering size press.

2. Background Information

Conventional metering size press loading systems use a pivoting roll to load the rolls together. With this style design, there are several factors effecting nip loading. These factors include total roll weight, roll to roll weight variations, roll weight variation front to back due to design differences, the weight of the water inside the roll to provide cooling and heating.

In the past, the film coater roll cover was much harder compared with covers used today. Covers used to have a hardness of 10 P&J compared with 40 P&J today. Also the average operating nip level was considerably higher years ago. For example 250 pli compared with 100 pli today. A harder cover operating at higher nip pressures minimizes the influence of the aforementioned factors. A softer cover operating at lower nip pressures is much more sensitive to these factors.

The control system must very accurately measure and control the nip loading. In actual operation this is very difficult to do. The result is inaccurate nip loading, biased nip loading front to back and non-uniform nip pressures when the nip is closed.

The present invention provides a means for controlling the nip pressure without any effect from the aforementioned factors. Therefore, the control of the present invention makes such control much more accurate and provides a more simple method of controlling nip pressure.

The roll that is moved to nip against the fixed roll is mounted on linear bearings. The linear bearings provide a means of aligning the moving roll. Hydraulic cylinders control the nip loading. The following advantages are realized:

- The linear bearings have a relatively constant friction value when they are moved. This provides more consistent, accurate nip loading control.
- The hydraulic cylinder is smaller which results in lower flow requirements and faster response.
- The nip loading is purely a function of the roll geometry (not weight).
- Zero pli nip loading=zero psi cylinder pressure. With prior art design, zero pli nip loading was governed by the roll weight+pivot arm weight+friction+other factors. This resulted in the hydraulic cylinder pressure transmitter working over a very small range e.g., a 10% change in nip loading=a 1% change in the control values.

The front and back posts for the moving roll are mounted on linear bearings. The linear bearings provide an accurate means of positioning the moving roll in the machine and height directions. Hydraulic cylinders, located on the front and back posts, are used to move the posts. The hydraulic cylinders are sized to provide the required nip loading. As such, they can be considerably smaller than existing designs. The design may, or may not, have a cross shaft connecting the front and back posts. The preferred method would not have a cross shaft. The synchronization of the front and back posts can be accomplished with either position feedback devices or a cross shaft. The preferred method is to have three positions for the moving roll as follows:

1/ fully retracted,

2/ ready to load position, and

3/ loaded.

The ready to load position is with the rolls having a 0.5" gap.

Load cell feedback of the nip loading can be incorporated into the design. This can be done in many different ways. The two preferred methods are to incorporate a pin type load cell into the hydraulic cylinder or to use a compression type load cell in the front and back framework. Roll weight, external loading, or other factors do not affect the pin load cell design. It is the simplest and cleanest means of providing load cell feedback to the control system. The compression type load cell design will be affected by the roll weight. As such, the signal-to-noise ratio will not be as good as with the pin type design.

Therefore, a primary feature of the present invention is the provision of a control apparatus for controlling nip pressure in a nip of a metering size press that overcomes the problems associated with the prior art arrangements.

Another feature of the present invention is the provision of a control apparatus for controlling nip pressure in a nip of a metering size press that provides more consistent, accurate loading control.

A further feature of the present invention is the provision of a control apparatus for controlling nip pressure in a nip of a metering size press that provides faster response.

Other features and advantages of the present invention will be readily apparent to those skilled in the art by a consideration of the detailed description of a preferred embodiment of the present invention contained herein.

SUMMARY OF THE INVENTION

The present invention relates to a control apparatus for controlling nip pressure in a nip, of a metering size press. The apparatus includes a metering size press roll and a backing roll which cooperates with the size press roll for defining therebetween the nip. A support post is provided for rotatably supporting the backing roll. A linear bearing is disposed beneath the support post for mounting the support post. Also, a moving device is connected to the support post for moving the support post and the backing roll supported by the support post such that the supported backing roll and the support post mounted on the linear bearing is moved for controlling the nip pressure in the nip between the rolls.

In a more specific embodiment of the present invention, the control apparatus further includes a further support post which is disposed spaced from the support post for supporting the size press roll.

Also, the control apparatus further includes a size applicator which cooperates with a surface of the backing roll for applying size to the surface such that when a web extends through the nip, a coating of size is transferred from the surface of the backing roll onto a first face of the web.

Additionally, the control apparatus further includes a further size applicator which cooperates with a further surface of the size press roll for applying size to the further surface such that when the web extends through the nip, a further coating of size is transferred from the further surface of the size press roll onto a second face of the web.

Moreover, the linear bearing is disposed beneath the support post for permitting the support post to be bearingly moved between a fully retracted disposition, a ready to load disposition and a loaded disposition.

Furthermore, the support post is bearingly moved in a direction which is disposed normal to an axis of rotation of the backing roll.

More specifically, the fully retracted disposition is such that the backing roll and the size press roll define therebetween a gap which permits the threading therethrough of the web.

The ready to load disposition is such that the backing roll and the size press roll define therebetween a further gap which is within a range 0.25 to 0.75 inches.

Also, the loaded disposition is such that the backing roll and the size press roll define therebetween the nip.

The moving device includes a cylinder having a first and a second end, the first end being secured to the support post while the second end is secured relative to the size press roll such that when the cylinder is operated, the support post is moved relative to the size press roll.

In a preferred embodiment of the present invention, the cylinder is a hydraulically operated cylinder.

However, in another embodiment of the present invention, the cylinder is a pneumatically operated cylinder.

The moving device includes a cylinder having a first and a second end, the first end being pivotally secured to the support post.

The apparatus further including a base, the linear bearing and the further support being secured to the base. The second end of the cylinder is pivotally secured to the base such that when the cylinder is operated, the support post is moved relative to the size press roll.

Moreover, the control apparatus further includes at least one load cell for measuring nip loading of the nip and a control for controlling the moving device. A feedback circuit is connected to the load cell and to the control for controlling movement of the support post.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWING

Similar reference characters refer to similar parts throughout the various views of the drawings.

DETAILED DESCRIPTION OF THE DRAWING

Figure 1:
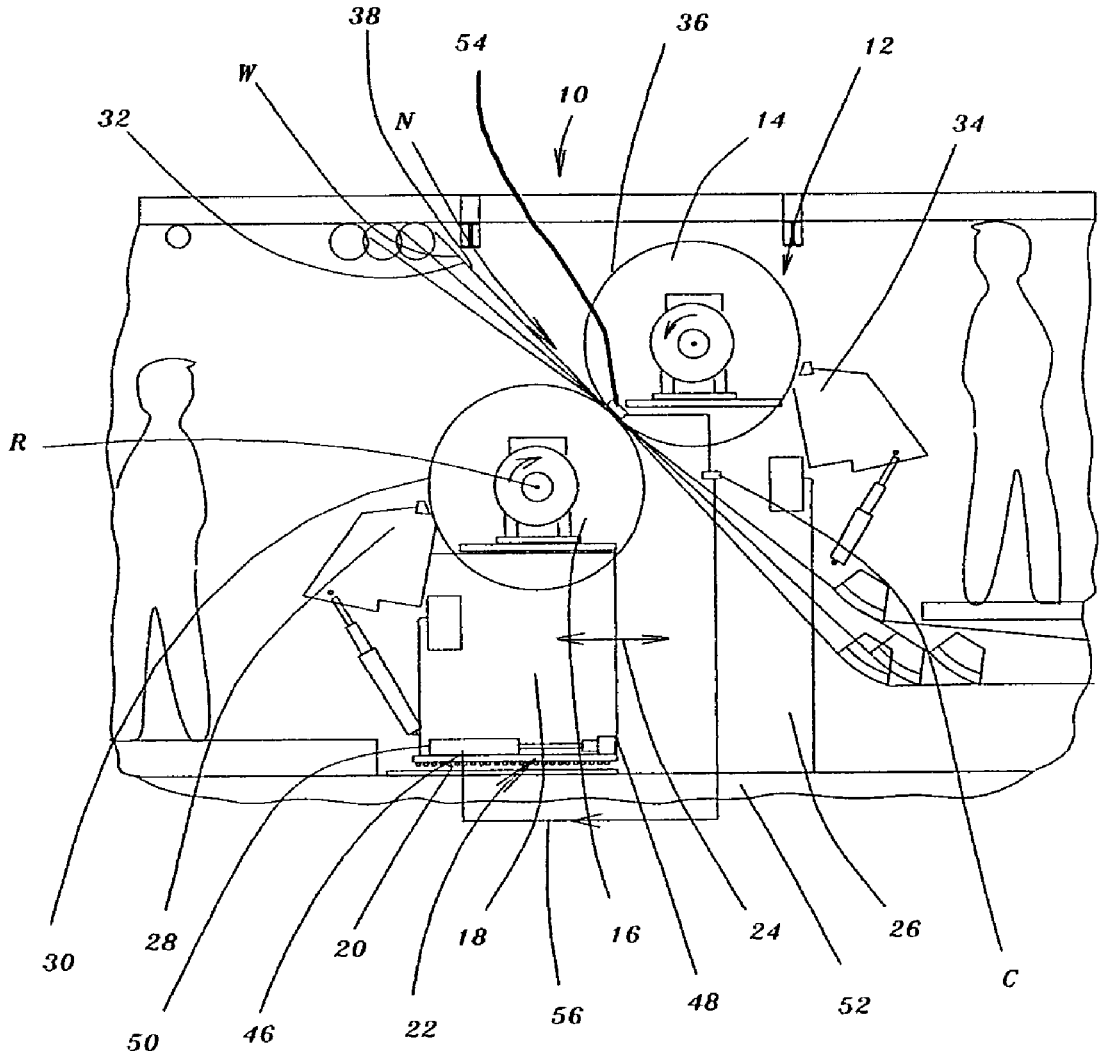
FIG. 1 is a side elevational view of the control apparatus according to the present invention.

FIG. 1 is a side elevational view of the control apparatus according to the present invention. As shown in FIG. 1, a control apparatus generally designated 10 controls the nip pressure in a nip generally designated N of a metering size press generally designated 12. The apparatus 10 includes a metering size press roll 14 and a backing roll 16 which cooperates with the size press roll 14 for defining therebetween the nip N. A support post 18 is provided for rotatably supporting the backing roll 16. A linear bearing 20 is disposed beneath the support post 18 for mounting the support post 18. Also, a moving device generally designated 22 is connected to the support post 18 for moving the support post 18 and the backing roll 16 supported by the support post 18 as indicated by the arrow 24 such that the supported backing roll 16 and the support post 18 mounted on the linear bearing 20 is moved for controlling the nip pressure in the nip N between the rolls 14 and 16.

In a more specific embodiment of the present invention, the control apparatus 10 further includes a further support post 26 which is disposed spaced from the support post 18 for supporting the size press roll 14.

Also, the control apparatus 10 further includes a size applicator 28 which cooperates with a surface 30 of the backing roll 16 for applying size to the surface 30 such that when a web W extends through the nip N, a coating of size is transferred from the surface 30 of the backing roll 16 onto a first face 32 of the web W.

Additionally, the control apparatus 10 further includes a further size applicator 34 which cooperates with a further surface 36 of the size press roll 14 for applying size to the further surface 36 such that when the web W extends through the nip N, a further coating of size is transferred from the further surface 36 of the size press roll 14 onto a second face 38 of the web W.

Moreover, the linear bearing 20 is disposed beneath the support post 18 for permitting the support post 18 to be bearingly moved as indicated by the arrow 24.

Figure 2:
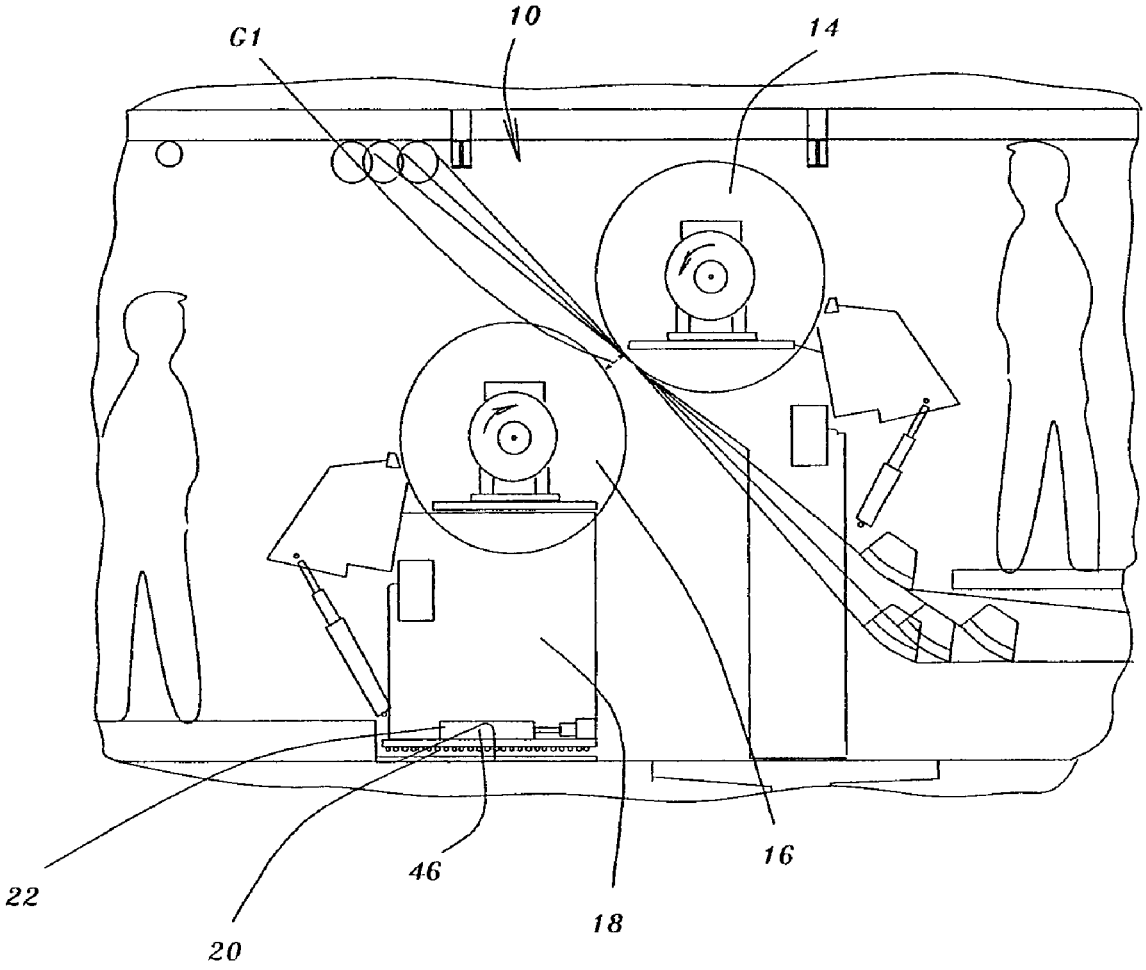
FIG. 2 is a similar view to that shown in FIG. 1 but shows the support post 18 having been moved as indicated by the arrow 24 to a fully retracted disposition.

FIG. 2 is a similar view to that shown in FIG. 1 but shows the support post 18 having been moved as indicated by the arrow 24 to a fully retracted disposition.

Figure 3:
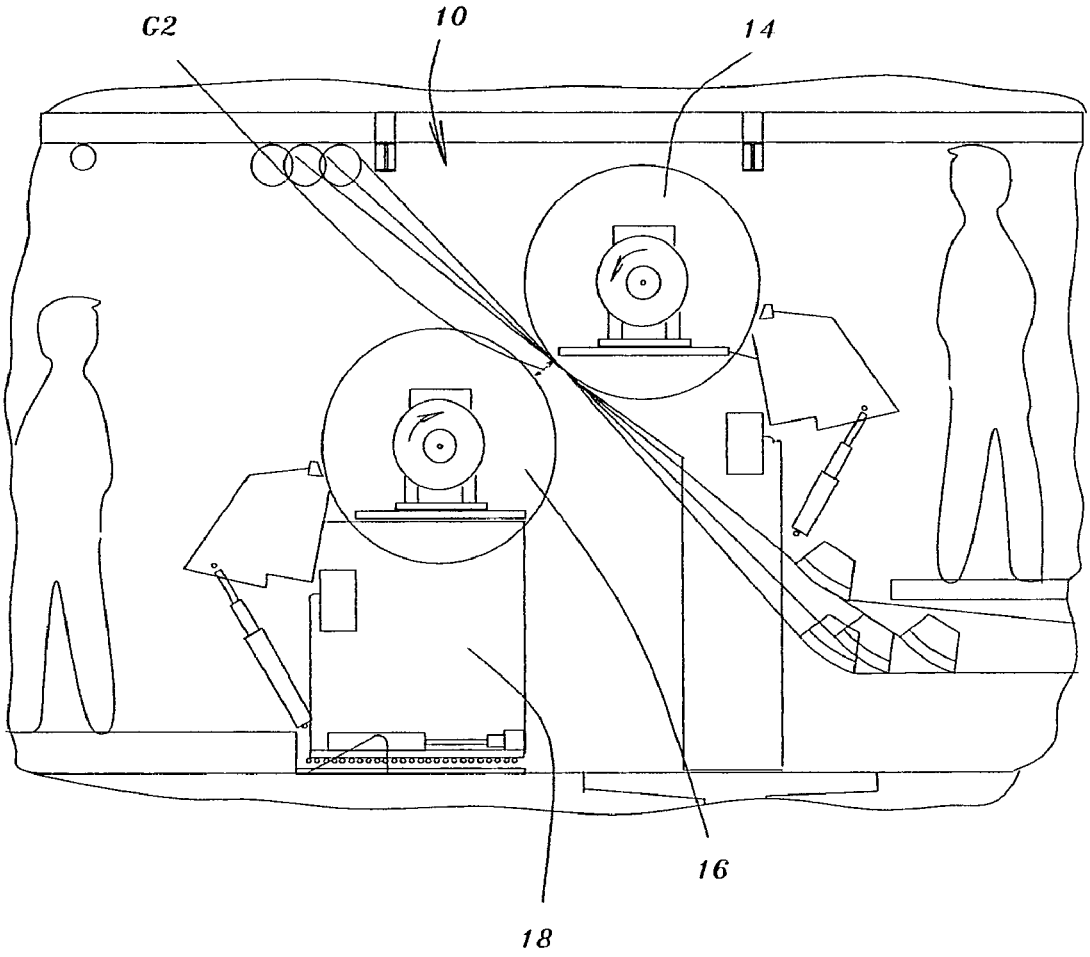
FIG. 3 is a similar view to that shown in FIG. 1 but shows the support post 18 having been moved as indicated by the arrow 24 to a ready to load disposition.

FIG. 3 is a similar view to that shown in FIG. 1 but shows the support post 18 having been moved as indicated by the arrow 24 to a ready to load disposition.

FIG. 1 shows the support post 18 having been moved as indicated by the arrow 24 to a loaded disposition.

Furthermore, the support post 18 is bearingly moved in the direction as indicated by the arrow 24, the direction 24 being disposed normal to an axis of rotation R of the backing roll 16.

More specifically, the fully retracted disposition shown in FIG. 2 is such that the backing roll 16 and the size press roll 14 define therebetween a gap G1 which permits the threading therethrough of the web W.

The ready to load disposition shown in FIG. 3 is such that the backing roll 16 and the size press roll 14 define therebetween a further gap G2 which is within a range 0.25 to 0.75 inches and preferably 0.50 inches.

Also, the loaded disposition shown in FIG. 1 is such that the backing roll 16 and the size press roll 14 define therebetween the nip N.

The moving device 22 includes a cylinder 46 having a first and a second end 48 and 50 respectively. The first end 48 is secured to the support post 18 while the second end 50 is secured relative to the size press roll 14 such that when the cylinder 46 is operated, the support post 18 is moved as indicated by the arrow 24 relative to the size press roll 14.

In a preferred embodiment of the present invention, the cylinder 46 is a hydraulically operated cylinder.

However, in another embodiment of the present invention, the cylinder 46 is a pneumatically operated cylinder.

More specifically, the first end of the cylinder is, pivotally secured to the support post 18.

As shown in FIGS. 1-3, the apparatus further includes a base 52. The linear bearing 20 and the further support post 26 are secured to the base 52. The second end 50 of the cylinder 46 is pivotally secured to the base 52 such that when the cylinder 46 is operated, the support post 18 is moved as indicated by the arrow 24 relative to the size press roll 14.

Moreover, the control apparatus 10 further includes at least one load cell 54 for measuring nip loading of the nip N and a control C for controlling the moving device 22. A feedback circuit generally designated 56 is connected to the load cell 54 and to the control C for controlling movement as indicated by the arrow 24 of the support post 18.

In operation of the control apparatus 10, the control C is set to move the support post 18 to the fully retracted disposition shown in FIG. 2. The web W is threaded through the gap G1 and the control C is set so that the hydraulic cylinder moves the support post 18 to the ready to load disposition shown in FIG. 3 with the gap G2 of 0.50 inches between the rolls 14 and 16. The control is then set to move the support post to the loaded disposition shown in FIG. 1 with the rolls 14 and 16 defining the nip N. The applicators 28 and 34 then supply size to the rotating surfaces 30 and 36 for applying coatings of size onto the first and second face 32 and 38 of the web W.

Those skilled in the art will appreciate that alternatively, the further support post 26 could be supported on a linear bearing rather than the support post 18 being supported by the linear bearing. Also, the support post 18 includes a front and a back post for rotatably supporting the backing roll journals. The front and back post may be tied together with a cross shaft extending from the front to the back post and disposed spaced and parallel to the axis of rotation R of the backing roll. Additionally, it will be understood by those skilled in the art that the cylinder 46 can include a front and a back cylinder for moving the front and back post respectively on front and back linear bearings.

The present invention provides a unique control apparatus for controlling and maintaining a consistent and accurate nip pressure of a metering size press.

What is claimed is:

1. A control apparatus for controlling nip pressure in a nip of a metering size press, said apparatus comprising:

a metering size press roll;

a backing roll cooperating with said size press roll for defining therebetween the nip;

a support post for rotatably supporting said backing roll;

a linear bearing for mounting said support post;

a moving device connected to said support post for moving said support post and said backing roll supported by said support post such that said supported backing roll and said support post mounted on said linear bearing is moved for controlling the nip pressure in the nip between said rolls; and said moving device including:

a cylinder having a first and a second end, said first end being secured to said support post, said second end being secured relative to said size press roll such that when said cylinder is operated, said support post is moved relative to said size press roll.

2. A control apparatus as set forth in claim 1 further including:

a further support post disposed spared from said support post for supporting said size press roll.

3. A control apparatus as set forth in claim 1 further including:

a size applicator cooperating with a surface of said backing roll for applying size to said surface such that when a web extends through the nip, a coating of size is transferred from said surface of said backing roll onto a first face of the web.

4. A control apparatus as set forth in claim 3 further including:

a further size applicator cooperating with a further surface of said size press roll for applying size to said further surface such that when said web extends through the nip, a coating of size is transferred from said further surface of said size press roll onto a second face of the web.

5. A control apparatus as set forth in claim 1 wherein said linear bearing is disposed beneath said support post for permitting said support post to be bearingly moved between a fully retracted disposition, a ready to load disposition and a loaded disposition.

6. A control apparatus as set forth in claim 5 wherein said support post is bearingly moved in a direction disposed normal to an axis of rotation of said backing roll.

7. A control apparatus as set forth in claim 5 wherein said fully retracted disposition is such that said backing roll and said size press roll define therebetween a gap which permits the threading therethrough of a web.

8. A control apparatus as set forth in claim 5 wherein said ready to load disposition is such that said backing roll and said size press roll define therebetween a further gap which is within a range .25 to .75 inches.

9. A control apparatus as set forth in claim 1 wherein a loaded disposition is such that said backing roll and said size press roll define therebetween the nip.

10. A control apparatus as set forth in claim 1 wherein said cylinder is a hydraulically operated cylinder.

11. A control apparatus as set forth in claim 1 wherein said cylinder is a pneumatically operated cylinder.

12. A control apparatus as set forth in claim 1 wherein said moving device includes:

said cylinder having said first and said second end, said first end being pivotally secured to said support post;

said apparatus further including:

a base, said linear bearing and said further support being secured to said base;

said second end being pivotally secured to said base such that when said cylinder is operated, said support post is moved relative to said size press roll.

13. A control apparatus as set forth in claim 1 further including:

at least one load cell for measuring nip loading of the nip;

a control for controlling movement of said moving device;

a feedback circuit connected to said load cell and to said control for controlling movement of said support post.

14. A control apparatus for controlling nip pressure in a nip of a metering size press, said apparatus comprising:

a metering size press roll;

a backing roll cooperating with said size press roll for defining therebetween the nip;

a support post for rotatably supporting said backing roll;

a linear bearing for mounting said support post;

a moving device connected to said support post for moving said support post and said backing roll supported by said support post such that said supported backing roll and said support post mounted on said linear bearing is moved for controlling the nip pressure in the nip between said rolls;

a further support post disposed spaced from said support post for supporting said size press roll;

a size applicator cooperating with a surface of said backing roll for applying size to said surface such that when a web extends through the nip, a coating of size is transferred from said surface of said backing roll onto a first face of the web;

a further size applicator cooperating with a further surface of said size press roll for applying size to said further surface such that when a web extends through the nip, a coating of size is transferred from said further surface of said size press roll onto a second face of the web;

said linear bearing is disposed beneath said support post for permitting said support post to be bearingly moved between a fully retracted disposition, a ready to load disposition and a loaded disposition;

said support post is bearingly moved in a direction disposed normal to an axis of rotation of said backing roll;

said fully retracted disposition is such that said backing roll and said size press roll define therebetween a gap which permits the threading therethrough of a web;

said ready to load disposition is such that said backing roll and said size press roll define therebetween a further gap which is within a range 0.25 to 0.75 inches;

said loaded disposition is such that said backing roll and said size press roll define therebetween the nip;

said moving device includes:

a cylinder having a first and a second end, said first end being secured to said support post, said second end being secured relative to said size press roll such that when said cylinder is operated, said support post is moved relative to said size press roll;

said cylinder is a hydraulically operated cylinder;

a base, said linear bearing and said further support being secured to said base;

said second end of said cylinder being pivotally secured to said base such that when said cylinder is operated, said support post is moved relative to said size press roll;

at least one load cell for measuring nip loading of the nip;

a control for controlling said moving device; and a feedback circuit connected to said load cell and to said control for controlling movement of said support post.

* * * * *

UNITED STATES PATENT AND TRADEMARK OFFICE

CERTIFICATE OF CORRECTION

PATENT NO. : 7,823,531 B2
APPLICATION NO. : 11/402280
DATED : November 2, 2010
INVENTOR(S) : Philip W Smith It is certified that error appears in the above-identified patent and that said Letters Patent is hereby corrected as shown below:

Column 5, line 66 should read --spaced-- rather than "spared"

Signed and Sealed this
Fourth Day of January, 2011

David J. Kappos

David J. Kappos
*Director of the United States Patent and Trademark Office*